United States Patent [19]

Brisland

[11] Patent Number: 4,598,627

[45] Date of Patent: Jul. 8, 1986

[54] FLUID MOTORS

[76] Inventor: Michael J. Brisland, 6, Keeble Close, Tiptree Essex, England

[21] Appl. No.: 511,140

[22] PCT Filed: Nov. 1, 1982

[86] PCT No.: PCT/GB82/00312

§ 371 Date: Jun. 13, 1983

§ 102(e) Date: Jun. 13, 1983

[87] PCT Pub. No.: WO83/01649

PCT Pub. Date: May 11, 1983

[30] Foreign Application Priority Data

Nov. 2, 1981 [GB] United Kingdom ..... 8133005

[51] Int. Cl.[4] ..... F01B 1/00

[52] U.S. Cl. ..... 91/477; 91/189 A; 91/192; 91/490; 91/491; 91/499

[58] Field of Search ..... 91/477, 491, 189 A, 91/192, 490, 499, 501

[56] References Cited

U.S. PATENT DOCUMENTS

| | | | |
|---|---|---|---|
| 46,470 | 2/1865 | Hicks | 91/490 |
| 2,931,312 | 4/1960 | Donner | 91/477 |
| 3,075,504 | 1/1963 | Vogel | 91/491 |
| 3,150,603 | 9/1964 | Yarger | 91/477 |
| 3,266,436 | 8/1966 | Yarger | 91/477 |

FOREIGN PATENT DOCUMENTS

| | | | |
|---|---|---|---|
| 1229643 | 4/1971 | United Kingdom . | |
| 2067248 | 7/1981 | United Kingdom | 91/491 |

*Primary Examiner*—Abraham Hershkovitz

*Attorney, Agent, or Firm*—Biebel, French & Nauman

[57] ABSTRACT

A fluid motor operated by a gas or liquid and having two relatively rotatable parts comprises a plurality of pistons which cooperate with a cam member to produce the rotational output from the motor. The cam member has at least three similar lobes and forms one of the parts and the other part includes at least four cylinders each containing a piston. Each piston/cylinder combination also acts as a slide valve so as to control both the supply of fluid to one of the other pistons and the exhausting of fluid from another of the other pistons.

9 Claims, 6 Drawing Figures

FLUID MOTORS

Figure 1:
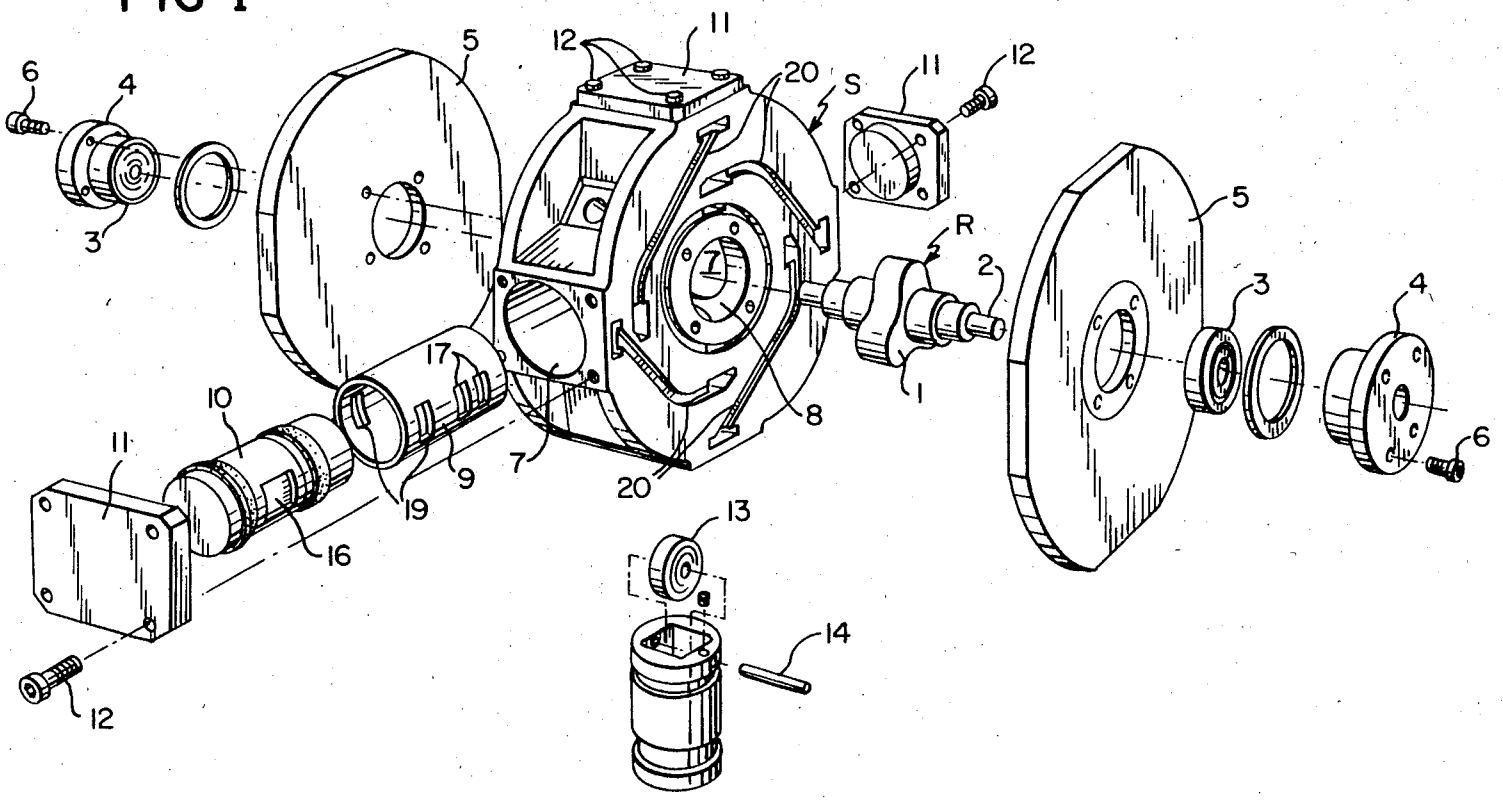

The present invention relates to fluid motors and more particularly to motors in which the operating fluid is a gas, such as air.

The invention is particularly concerned with fluid motors in which a plurality of pistons, whose reciprocation is controlled by the fluid, cooperate with a cam member to produce the rotational output from the motor and wherein the pistons also act as valve members controlling the fluid flow. Various designs of such a motor have been proposed, in many of which the rotor consists of an eccentric or twin lobe cam member which is caused to rotate in response to the actuation of a plurality of pistons disposed about and associated with the rotor. However, existing designs suffer from a number of disadvantages amongst which are relatively low power output and uneven torque, relatively poor low speed and starting characteristics and undesirably high vibration and noise.

It is an object of the present invention to provide an improved fluid motor.

The present invention consists in a fluid motor having two relatively rotatable parts, one of said parts comprising a cam member having at least three similar lobes and the other of said parts comprising at least four cylinders each containing a reciprocatable piston, each piston and its associated cylinder also acting as a slide valve so as to control the supply of fluid to one of the other pistons and the exhausting of fluid from another of the other pistons, said pistons producing a force on said cam member to effect the relative rotation of said parts.

Advantageously separate passages are provided for supplying fluid to the pistons and for exhausting fluid from the pistons and the fluid supply passages and fluid exhaust passages are similar so that the function of the passages can be interchanged thereby enabling the motor to be rotated in either direction. Moreover, each cylinder piston combination is preferably constructed so as to provide a controlled leak or bleed past the piston for the reasons which will be hereinafter explained.

In one construction according to the invention the pistons are disposed radially around the longitudinal axis of the cam member and one end of each piston is connected to a cam follower which engages with the cam member.

In an alternative construction the cylinders are disposed around and parallel to a central axis of the motor and a cam member cooperating with the pistons is disposed at at least one end of the motor. In such a construction the pistons may be double-ended, a cam member being disposed at each of two opposite ends of the motor.

Preferably each cylinder is formed with two groups of ports each of which cooperates with a separate cavity in the associated piston so as to form two slide valves controlling respectively the supply and exhausting of the fluid.

In a preferred construction the motor comprises a body including the cylinders and has fluid supply and exhaust passages formed as channels in at least one surface of the body and communicating with the ports in the cylinders, and at least one cover is secured to the body to cover the channels and thereby form enclosed passages.

In one specific form of the motor the body is generally cylindrical and has the channels formed in its end surfaces and covered by end plates. In another form of the motor the body is a cylinder having the channels formed in the annular cylinder surface and covered by a cylindrical sleeve.

The invention also provides a method of operating a fluid motor as above described which consists in applying fluid simultaneously to both the fluid supply and exhaust passages so as to brake the motor and hold it against rotation.

The invention further provides the method of operating a fluid motor as above described which consists in removing the fluid supply whereby the pistons are allowed to move out of contact with the cam member and hence the rotatable part of the motor can rotate freely until the fluid supply is restored and wherein fluid is bled past the pistons to bring adjacent pistons back into contact with the cam member.

The motor is preferably constructed with the cam member mounted as a rotor, for example mounted on a shaft which forms the rotational output of the motor, and the cylinders formed in a stator disposed about the axis of rotation of the rotor.

Figure 2:
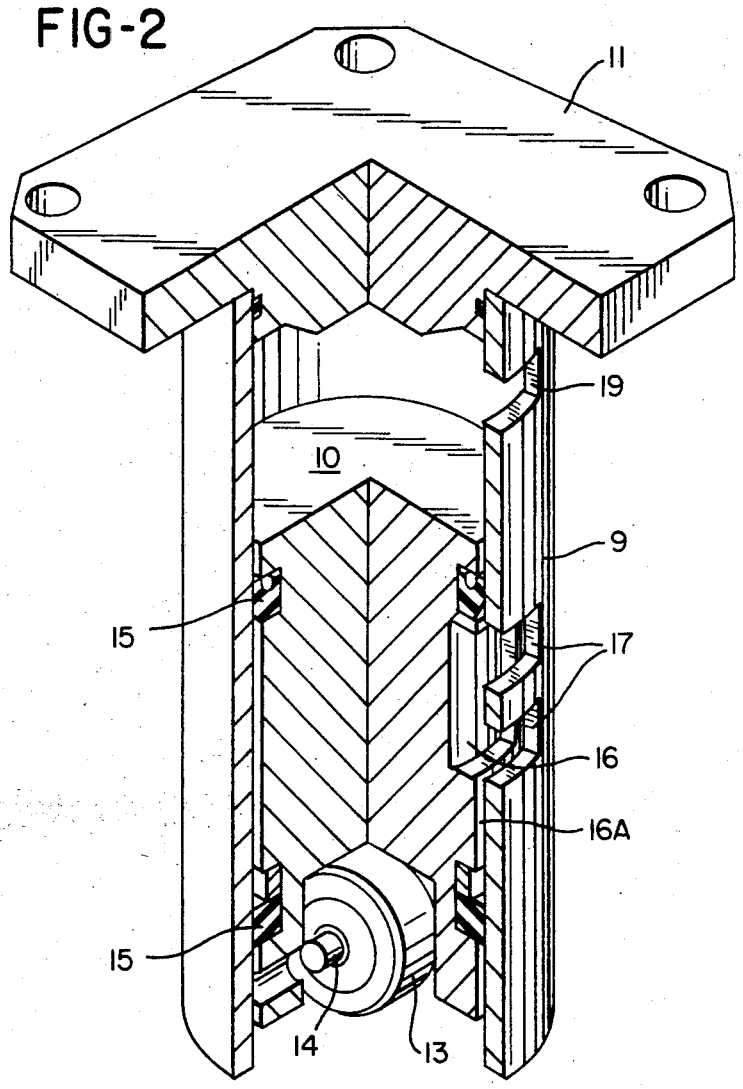
Figure 3A:
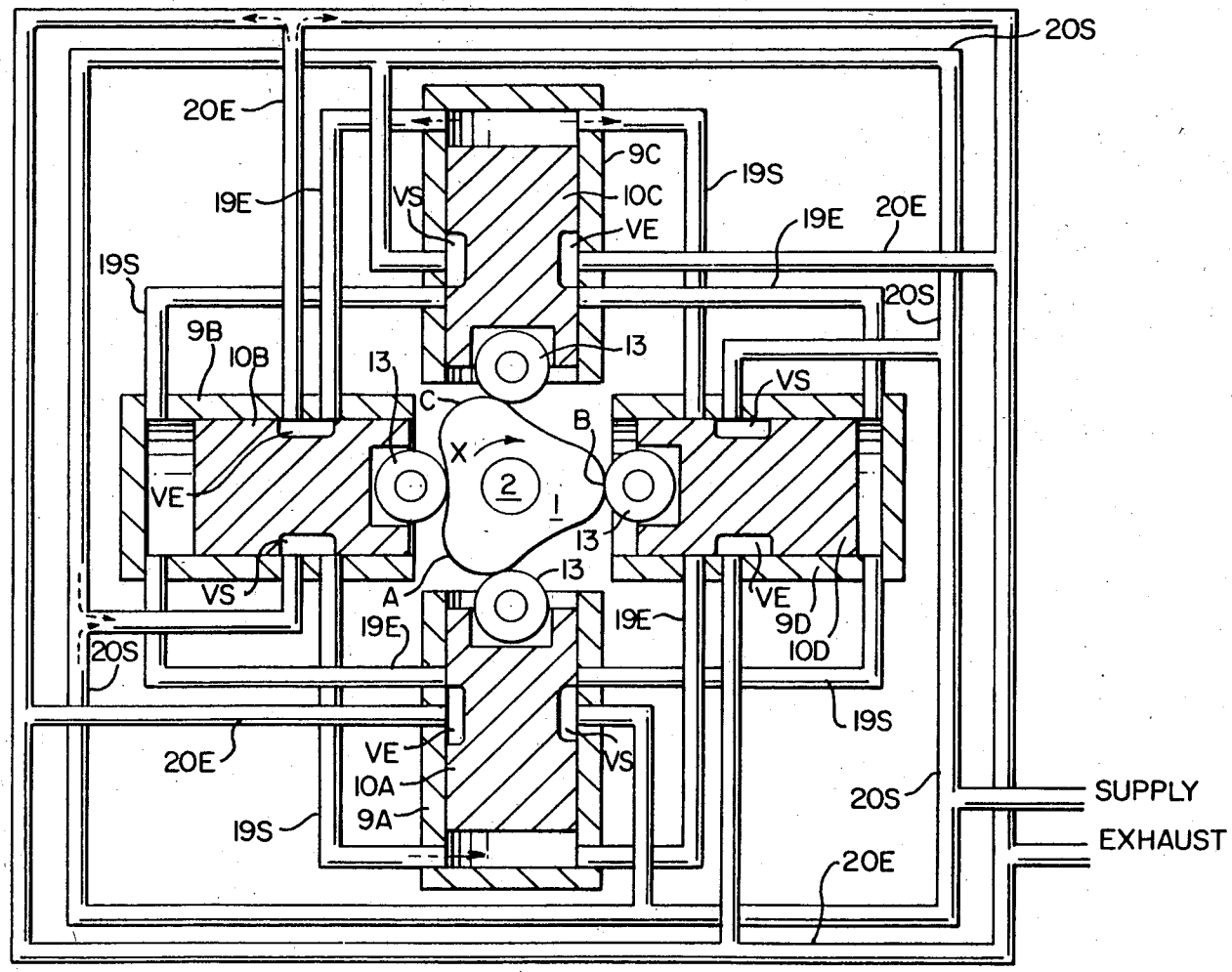
Figure 3B:
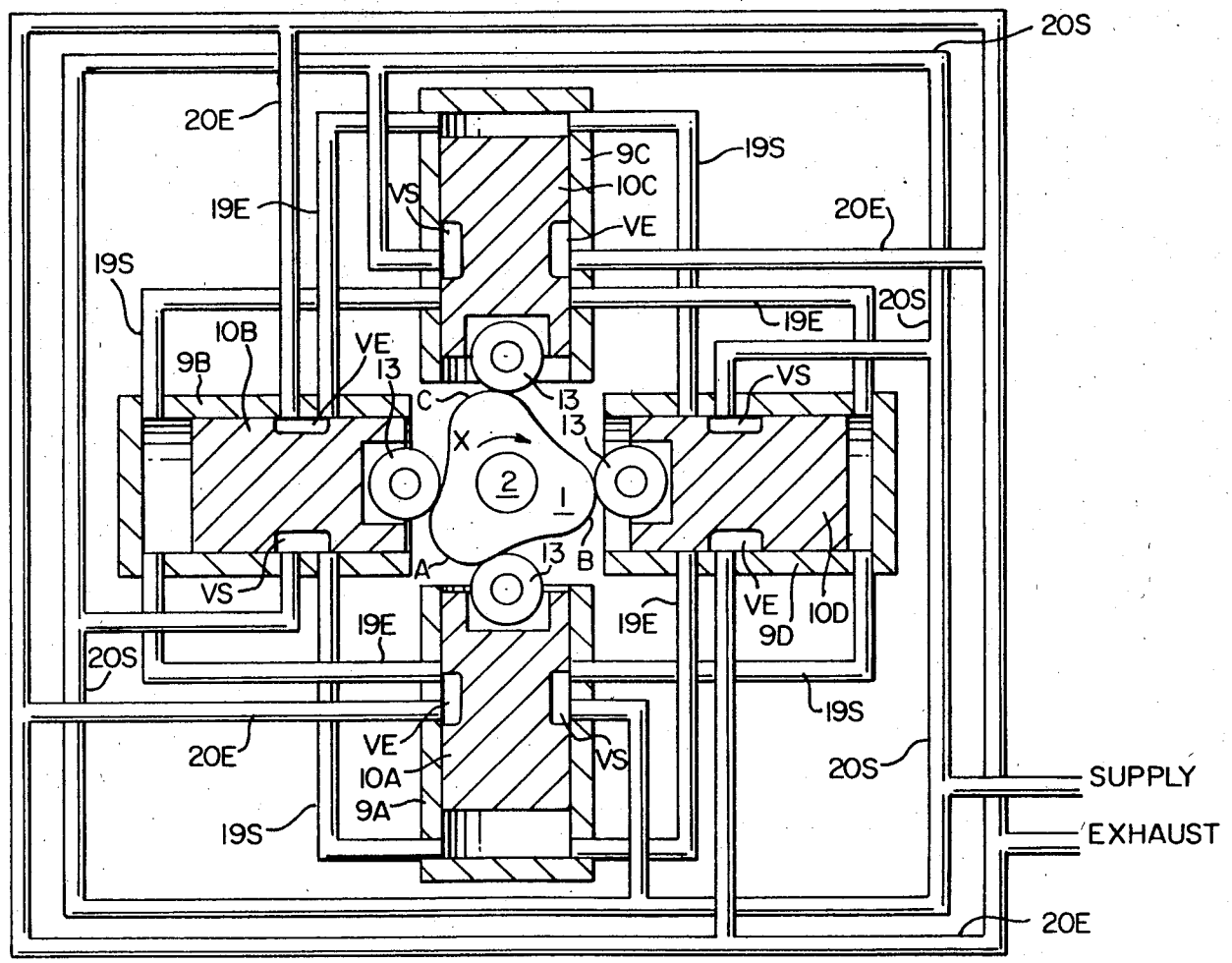
Figure 3C:
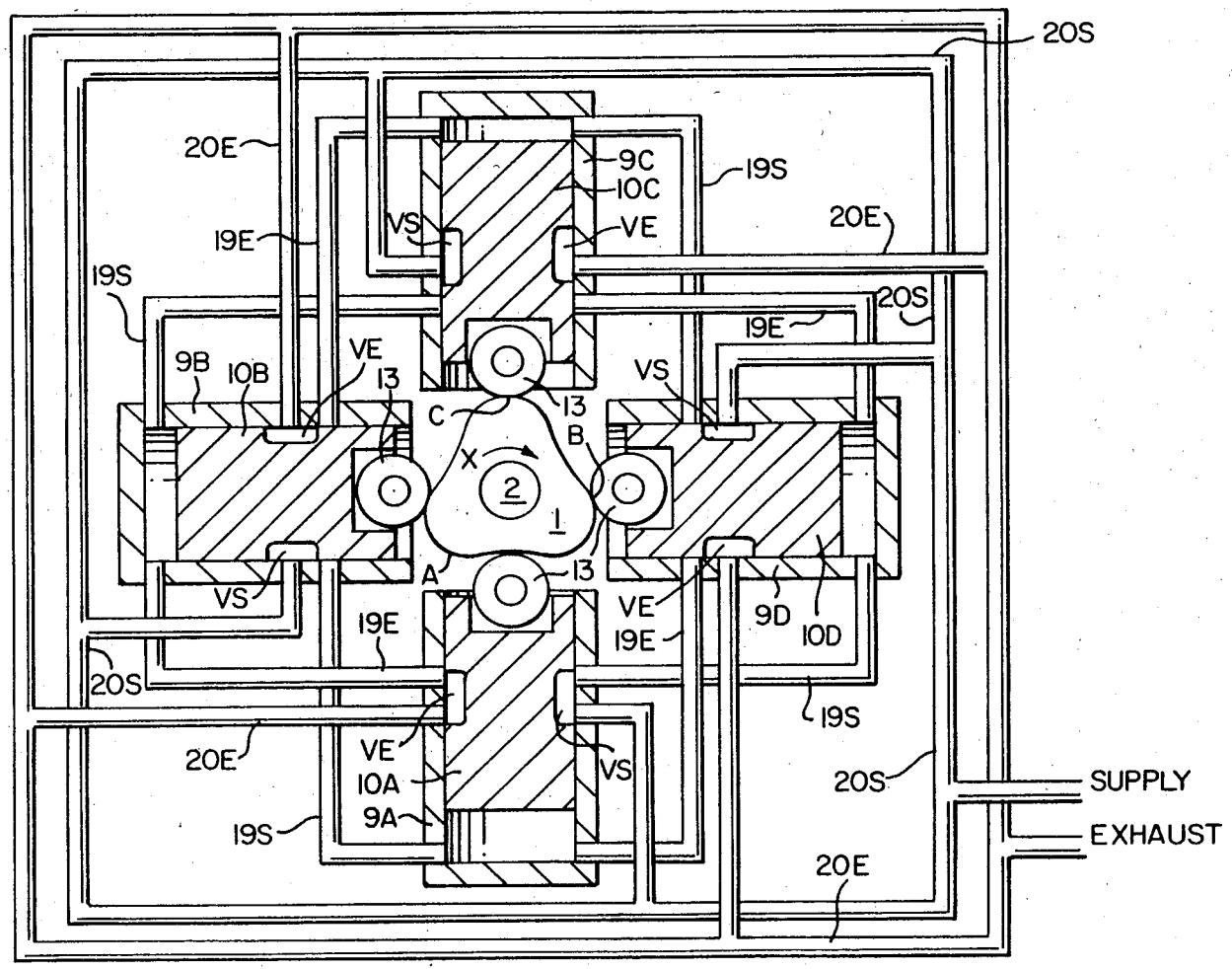
Figure 4:
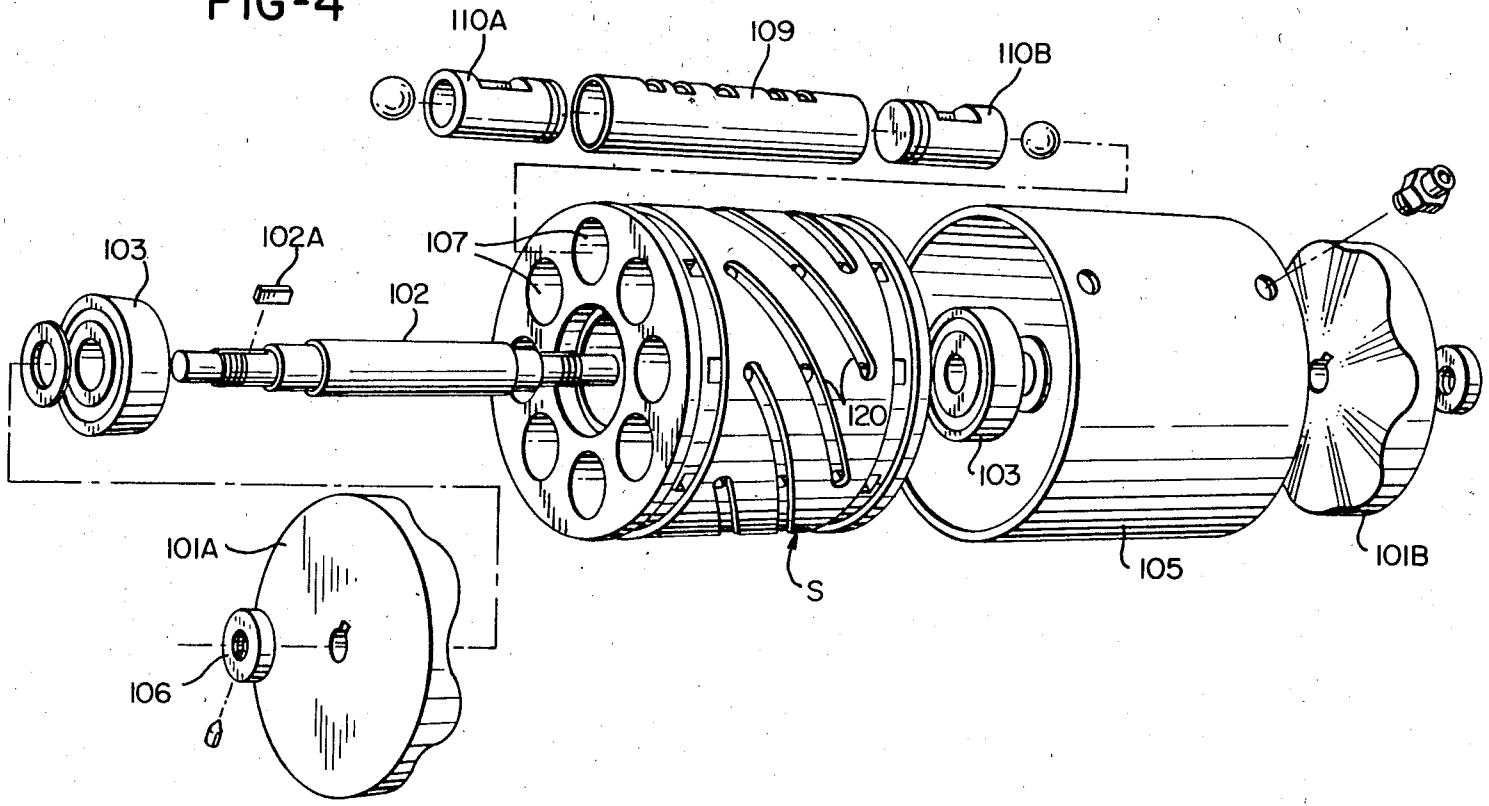

The invention will now be further described, by way of example, with reference to the accompanying drawings in which:

FIG. 1 is an exploded perspective view of one embodiment of a fluid motor according to the invention, FIG. 2 is a sectional view on a larger scale of a piston and cylinder construction, FIGS. 3A,3B and 3C are diagrams illustrating the mode of operation of the motor shown in FIG. 1, and FIG. 4 is an exploded perspective view of a second embodiment of fluid motor according to the invention.

Referring to FIGS. 1 and 2, the motor to be described is intended primarily as an air motor working from a supply of compressed air. The motor consists essentially of a rotor indicated at R and a stator indicated at S. The rotor comprises a tri-lobed cam 1 comprising three similar lobes mounted on a shaft 2. The ends of the shaft 2 are journalled in bearings 3 located in bosses 4 attached to the end covers 5 for the stator S by means of bolts 6.

The stator S comprises a generally cylindrical structure having four cylinder cavities disposed radially about the rotational axis of the rotor R which is located within the bore 8 of the stator. Each cylinder cavity 7 contains a cylinder liner 9 which in turn houses a piston 10, and each cylinder is closed by a cylinder head member 11 secured by bolts 12 to the stator S. The inner end of each piston is provided with a cam follower in the form of a roller 13 mounted on a spindle 14 and which engages the lobed surface of the cam 1 of the rotor R. Appropriate seals 15 are provided between the piston 10 and the cylinder linear 9. Diametrically opposite sides of each piston 10 are provided with a recess 16 which cooperates with a pair of rectangular ports 17 formed at diametrically opposite positions in the wall of the associated cylinder liner 9 so as to form a pair of slide valves to control the supply of fluid to and exhaustion of fluid from the rear ends of adjacent pistons. This is effected via the ports 19 in the cylinder liners 9 and the passages, such as 20, formed as channels in the side walls of the stator S. These channels are formed into closed passages by the end covers 5 when they are secured in position on the stator S.

The configuration of the supply and exhaust passages is such that the supply of fluid to the rear end of any one of the pistons to urge it radially inwards is controlled by means of the slide valve in the following piston in the direction of rotation of the rotor, and the exhaustion of fluid from the cylinder as that one piston is radially retracted is controlled by means of the slide valve in the preceding piston taken in the direction of rotation. The supply of fluid to and exhaustion of fluid from the motor is achieved through connections to the stator which are not shown.

The operation of the motor mechanism just described will now be explained with reference to the diagrams of FIGS. 3A, 3B and 3C, in which many of the same reference numerals have been used for corresponding parts.

These Figures show the complete configuration of the fluid supply passages 19S,20S. and fluid exhaust passages 19E, 20E in conjunction with the associated slide valves VS and VE formed by the recesses 16 and ports 17 of the pistons 10 and cylinders 9.

The rotor 1 will be assumed to be rotating clockwise in the direction of the arrow X.

For ease of description the four cylinder and piston combinations 9,10 bear the respective suffix A,B,C and D.

Referring to FIG. 3A, piston 10A is shown as being supplied with compressed fluid to its rear end via the main supply line 20S, slide valve VS of piston 10B and line 19S connected to the rear of cylinder 9A. Thus the cam follower 13 of piston 10A is urged against the flank of the lobe A of cam 1 to rotate the cam in the clockwise direction. At the same time, pistons 10B and 10D are floating (since their cylinders are not connected to either the fluid supply or exhaust) and fluid is being exhausted from the rear of piston 10C via associated line 19E and the slide valve VE in piston 10B.

FIG. 3B shows the conditions when the piston 10A has almost completed its forward stroke and rotated the cam through some 15°. The supply of fluid is now being cut off from the piston 10A by gradual closing of the slide valve VS in the piston 10B as this piston retracts and the exhaustion of the fluid from the rear of the pistons 10C is also being completed via the gradual closing of slide valve VE in piston 10B. The next piston to provide a working stroke will be piston 10D acting on lobe B of the cam 1 and, as can be seen, compressed fluid from line 20S is already being admitted to the rear of this piston via partially open slide valve VS in piston 10A, whilst the rear of piston 10B opposite to piston 10D is being vented to exhaust line 20E through slide valve VE of piston 10A.

FIG. 3C shows a further stage in the rotation of the motor when the supply of fluid to the piston 10A is cut off, since it is at the end of its working stroke, and fluid is being fully supplied to the piston 10D through the slide valve VS in the piston 10A and exhausted from the piston 10B through the slide valve VE in the piston 10A. In this position the pistons 10A and 10C are floating. The cam 1 has now rotated through 30°. It will thus be seen that in this embodiment employing a three-lobed cam and four pistons, twelve discrete 30° positions for the rotor can be obtained.

It will also be understood that the sequence of operations as described in relation to the working stroke of piston 10A is repeated cyclically for each of the pistons 10B to 10D, thereby causing rotation of the rotor by sequential radially inward working strokes of the pistons acting on the lobes A, B and C of the cam 1.

FIG. 4 shows a further embodiment of motor according to the invention which is constructed so that the piston and cylinder combinations extend axially parallel to the rotatable shaft of the motor. Two pistons are provided in each cylinder and respectively cooperate with a cam member at the corresponding end of the motor to produce rotation of the shaft.

More specifically the motor comprises a stator S housing eight axially extending cylinders 107 each of which contains a cylinder liner 109 and two pistons 110A and 110B. The stator surrounds a shaft 102 mounted in bearings 103 fitted into the stator; and two rotors 101A,101B, each in the form of a six lobed cam member are attached one at each end of the shaft 102 and secured by means of a key 102A and a threaded collar 106. The fluid supply and exhaust passages are formed as channels 120 in the outer cylindrical surface of the stator S and are closed by a tubular cover sleeve 105 extending over the stator S. The motor operates generally in the same manner as has been described with reference to FIGS. 1 to 3.

In both of the constructions described, a controlled bleed or leak is provided past the slide valve around the surface of the piston. Alternatively this controlled bleed could be formed by a small hole through the piston or a flattened area or groove on the surface of the piston in the vicinity of the recesses 16, as shown at 16A in FIG. 2. Such an arrangement enables the motor to be run without fluid power supplied and with all the pistons out of contact with the rotor, for example when it is desired to rotate the rotor by hand. With such an arrangement the rotor can be rotated freely without any resistance being caused on the rotor, for example by springs urging the pistons into contact with the rotor, since no such springs are needed.

Moreover, by providing separate fluid supply and exhaust passages to each piston and a control bleed around the piston from the supply to the exhaust side it is always possible to urge one piston into contact with the cam of the rotor even from a "stalled position" and hence to start the motor without difficulty. On the contrary, prior art constructions always need to provide springs to urge the pistons against the rotor in order to prevent a permanently stalled condition.

Because the springs can be eliminated, the motor can spin freely when all the pistons are retracted and no power is on the motor whereby the rotor offers little resistance to manual manipulation.

Moreover, the use of individual inlet and outlet ports for each cylinder gives a fast response time to the motor on starting and stopping.

The constructions of fluid motor according to the invention provide the motor with a high starting torque, a substantially stepless speed control with little torque fluctuation, the ability to be stalled at a predetermined torque and a good tolerance to intermittent starting and reversing. The motor can also act as a brake by supplying fluid to both the supply and exhaust passages simultaneously.

In order to achieve the advantages of the present invention over previously proposed designs employing a single lobe or bi-lobed cam, it is essential that the motor should employ a cam member having at least three lobes in combination with at least four pistons. Such an arrangement provides at least twelve working strokes per revolution of the rotor that is to say a new power stroke is implemented for every 30 degrees of shaft rotation which leads to smooth torque transferance, reduced cyclic torque variation and improved starting torque characteristics. In addition, for a given power rating a three-lobed rotor will experience shorter piston strokes with reduced vibration and noise generation and produce better acceleration. The motor can also readily be made bi-directional and is very suitable for continuously reversing operations.

Furthermore, the motor has very good stepping characteristics with thirty degree steps in either direction and if employed in conjunction with a high reduction gearbox connected to its output, the resolution obtained would be sufficiently good to make the motor suitable for precise positional control applications, particularly where the suitability of air as the power supply and control media has advantages over other prime sources such as electricity or hydraulic fluid.

Whilst particular embodiments are being described it will be understood that various modifications may be made without departing from the scope of this invention. Thus, whilst the motor has been described as having a cylinder block as the stator and the cam member or members as the rotor, reverse constructions could also be devised in which the pistons were mounted in the rotational part of the motor and the cam member formed part of the stator.

The motor according to the present invention also lends itself to easy manufacture by means of well established machining and/or casting techniques without necessitating expensive and difficult machining operations or requiring complex and difficult casting techniques. The motor may be constructed mainly from metals, plastics materials or a combination of both materials.

It is also to be understood that whilst the motor has been primarily described as working from a gaseous fluid such as air, it may also be designed to work from a hydraulic fluid such as oil.

Moreover, the tri-lobed rotor shown may be of other specific shape, although its shape is preferably such as to produce a high harmonic power output, that is to say a continuous power output having relatively small fluctuations.

I claim:

1. A fluid motor having two relatively rotatable parts, one of said parts comprising a cam member having at least three similar lobes and the other of said parts having at least four cylinders, a reciprocatable piston located in each cylinder, two separate oppositely disposed cavities in the wall of each piston, two pairs of ports in the wall of each cylinder, each one of said pairs of ports cooperating with one of said cavities thereby to provide two individual slide valves, said two slide valves operating simultaneously with the reciprocation of the piston such that one slide valve controls the supply of fluid to a preceding piston in the direction of rotation of the motor and the other slide valve controls the exhaustion of fluid from a succeeding piston in said direction of rotation, the rotation of said motor being effected by the force of said pistons acting on said cam member.

2. A fluid motor as claimed in claim 1, in which the fluid supply passages and the fluid exhaust passages of the motor are similar such that the function of the passages can be interchanged thereby enabling the motor to be rotatably driven in either direction.

3. A fluid motor as claimed in claim 1, in which each cylinder and piston combination is constructed so as to provide a controlled leak or bleed past the piston.

4. A fluid motor as claimed in claim 1, in which the pistons are disposed radially around the axis of the cam member.

5. A fluid motor as claimed in claim 1, in which the cylinders are disposed around and parallel to a central axis of the motor and a cam member cooperating with said pistons is disposed at at least one end of the motor.

6. A fluid motor as claimed in claim 5, in which each cylinder contains two pistons and a cam member is disposed at each of the two opposite ends of the motor.

7. A fluid motor as claimed in claim 1, in which one end of each piston is connected to a cam follower which engages with the cam member.

8. A fluid motor having two relatively rotatable parts, one of said parts comprising a rotatable cam member having at least three similar lobes and the other of said parts comprising a stationary body member incorporating at least four cylinders, said cylinders being disposed about the axis of rotation of said cam member and each cylinder being diametrically opposite another cylinder, a reciprocatable piston located in each cylinder, one end of each piston being engageable with the cam member and the other end of each piston being free in said cylinder, two separate diametrically disposed cavities in the side wall of each piston, two pairs of ports in the wall of each cylinder, each one of said pairs of ports cooperating with one of said cavities thereby to provide two individual slide valves, said two slide valves operating simultaneously with the reciprocation of the piston such that one slide valve controls the supply of fluid to a preceding piston in the direction of rotation of the rotor and the other slide valve controls the exhaustion of fluid from a succeeding piston in said direction of rotation, the rotation of said rotor being effected by the force of said pistons acting on said cam member.

9. A fluid motor as claimed in claim 8, comprising a body having bores forming the cylinders and further having fluid supply and exhaust passages formed as channels in at least one surface of said body and at least one cover secured to said body to cover said channels and thereby form enclosed passages.

* * * * *